US011105578B1

(12) United States Patent
Parsekian et al.

(10) Patent No.: US 11,105,578 B1
(45) Date of Patent: Aug. 31, 2021

(54) RECOIL EXERCISER

(71) Applicant: U.S. Government as Represented by the Secretary of the Army, Dover, NJ (US)

(72) Inventors: James Parsekian, Morristown, NJ (US); Paul McDonald, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/012,243

(22) Filed: Sep. 4, 2020

Related U.S. Application Data

(60) Provisional application No. 62/906,121, filed on Sep. 26, 2019.

(51) Int. Cl.

| | |
|---|---|
| ***F41A 33/06*** | (2006.01) |
| ***F41A 27/30*** | (2006.01) |
| ***F41A 21/36*** | (2006.01) |
| ***F41A 25/26*** | (2006.01) |
| ***F41A 25/22*** | (2006.01) |

(52) U.S. Cl.
CPC ..... *F41A 27/30* (2013.01); *F41A 21/36* (2013.01); *F41A 25/26* (2013.01); *F41A 33/06* (2013.01); *F41A 25/22* (2013.01)

(58) Field of Classification Search
CPC ..... F41A 21/36; F41A 25/22; F41A 25/26; F41A 27/30; F41A 33/06
USPC ..... 89/1.1, 14.3, 14.5, 42.01
See application file for complete search history.

(56) References Cited

U.S. PATENT DOCUMENTS

| | | | | |
|---|---|---|---|---|
| 2,643,582 A * | 6/1953 | Heely | F41A 9/21 | 89/45 |
| 5,078,045 A | 1/1992 | Audino | | |
| 5,608,180 A * | 3/1997 | Balbo | F16B 21/16 | 89/198 |

FOREIGN PATENT DOCUMENTS

| | | |
|---|---|---|
| DE | 19638118 | 3/1997 |

* cited by examiner

*Primary Examiner* — Bret Hayes
(74) *Attorney, Agent, or Firm* — John P. DiScala

(57) ABSTRACT

An electric winch provides motive force, allowing the cannon to be pulled out of battery and returned to battery in a safe and controlled manner. After the system is attached to the large caliber weapon system, the operator can stand a safe distance away and control the complete operation with a remote. The recoil exerciser can be quickly attached to any large caliber weapon system via hooks and a wear-resistant sling.

10 Claims, 7 Drawing Sheets

RECOIL EXERCISER

CROSS-REFERENCE TO RELATED APPLICATIONS

This application claims the benefit under 35 USC § 119(e) of U.S. provisional patent application 62/906,121 filed on Sep. 26, 2019.

STATEMENT OF GOVERNMENT INTEREST

The inventions described herein may be manufactured, used and licensed by or for the United States Government.

FIELD OF THE INVENTION

The invention relates in general to large caliber gun systems and in particular to recoil exercisers for large caliber gun systems.

BACKGROUND OF THE INVENTION

Most modern large caliber gun systems are equipped with hydraulic recoil systems, which reduce energy transfer to the gun structure during gunfire. To accomplish this, recoil systems control the motion of the cannon as it is propelled out of battery by reactionary force (the recoil phase), and then return the cannon to battery to be ready for loading the next round (the counter-recoil phase).

Hydraulic buffers are used during the recoil phase to convert kinetic energy to heat energy, which is dissipated to the surrounding environment. Springs are incorporated into the system to return the cannon to battery, which are typically hydro-pneumatic accumulators or recuperators.

Buffers, accumulators, and recuperators frequently use sliding seals to contain pressure within hydraulic cylinders. During the recoil phases, these sliding seals travel along precision-machined surfaces at high speed. Over time, friction and abrasion cause wear to the seals, eventually allowing leaks to develop. Maintaining a lubricated surface for the seals to travel on can maximize the life of the seals, which in turn minimizes maintenance and maximizes availability of the weapon system.

Lubrication of a recoil system's internal sliding surfaces can be accomplished by routine live-fire usage of the weapon, or by an external means of forcing the cannon through the recoil phases—a process called exercising the recoil system. The most expedient methods of exercising do not require significant adjustment of the recoil system, such as emptying gasses or fluids. Historically, exercising field artillery howitzers involved wrecker trucks or cumbersome equipment. The problem is most apparent with large caliber towed howitzers, which may sit idle for long periods in remote locations.

The M777A2 155 mm Howitzer is a modern, lightweight, towed artillery system in service with the United States, Canada, Australia, and India. Existing maintenance standards recommend firing or exercising the recoil system of the M777A2 no less frequently than every 180 days. However, there are downsides to current approaches to exercising recoil including length of time to operate, cost and portions of the recoil stroke not being fully exercised thereby leaving a portion of the sealing surfaces unmaintained.

A need exists for a recoil exerciser which exercises the weapon system over the entire recoil stroke and which takes less time to operate than current solutions.

SUMMARY OF INVENTION

One aspect of the invention is a recoil exerciser for a large caliber weapon system comprising a muzzle strap, a muzzle pulley subassembly and a winch subassembly. The muzzle strap attaches to a muzzle of the weapon system. The muzzle pulley subassembly receives the muzzle strap and mounts to a barrel of the weapon system. The winching assembly attaches to a cradle assembly of the weapon system for controllably retracting a rope connected to the muzzle pulley subassembly thereby retracting the barrel of the weapon system and controllably releasing the rope thereby releasing the barrel over a full recoil stroke to exercise a recoil system of the weapon system. The power supply for providing electric power to the winching assembly.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A recoil exerciser for a large caliber weapon system provides an efficient and safe means for exercising recoil. Advantageously, the recoil exerciser is externally powered, remotely controlled, reversible and operates over the full recoil stroke.

An electric winch provides motive force, allowing the cannon to be pulled out of battery and returned to battery in a safe and controlled manner. After the system is attached to the large caliber weapon system, the operator can stand a safe distance away and control the complete operation with a remote. The recoil exerciser can be quickly attached to any large caliber weapon system via a wear-resistant sling.

Figure 1:
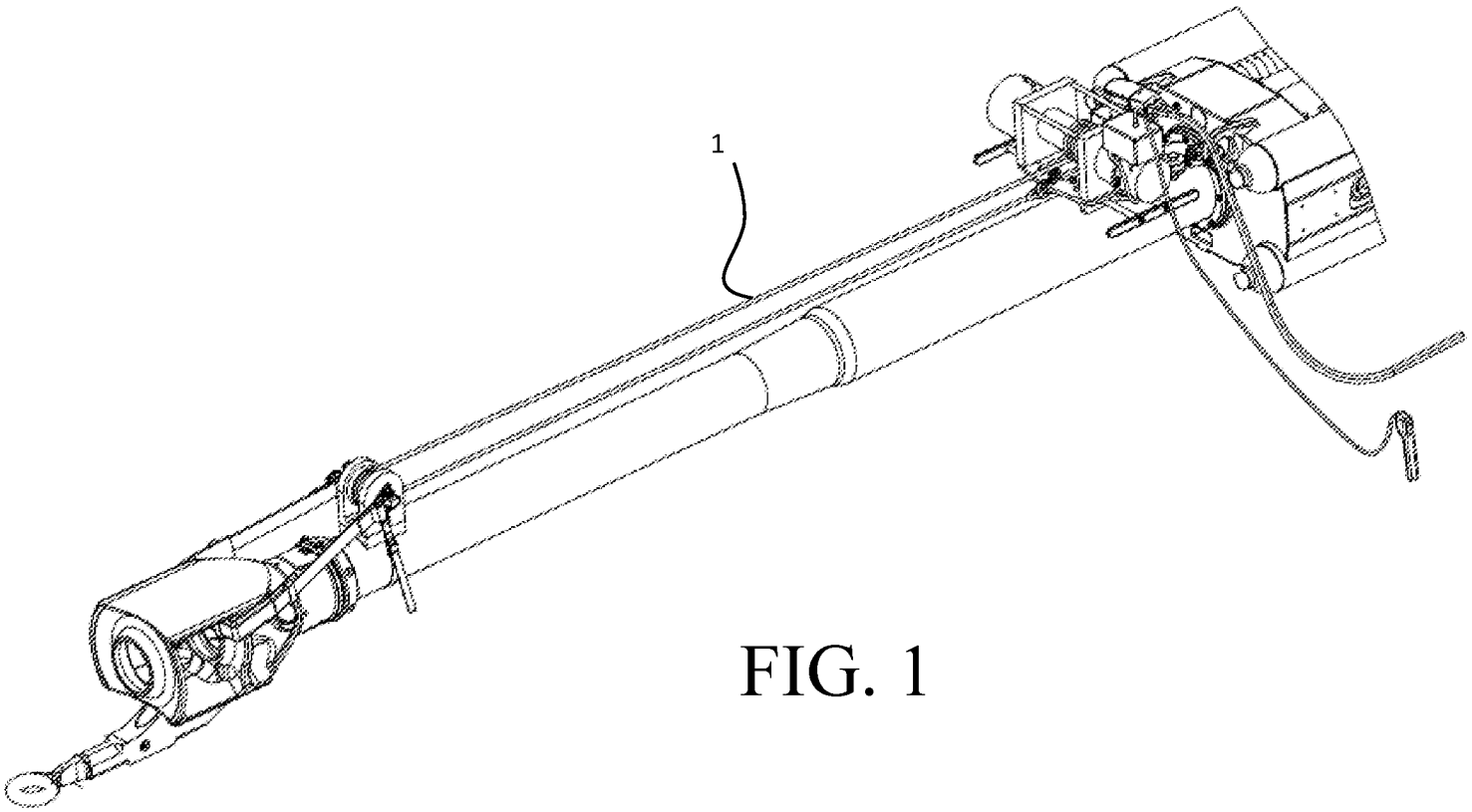
FIG. 1 illustrates the recoil exerciser installed on a large caliber weapon system, according to an embodiment of the invention.

FIG. 1 illustrates the recoil exerciser installed on a large caliber weapon system, according to an embodiment of the invention. In this embodiment, the recoil exerciser 1 is shown installed on a howitzer. However, the recoil exerciser 1 is not limited to use on howitzers and may be used on other large caliber weapon systems which require recoil exercising, such as tank cannons. For the purposes of this application, large caliber weapon system is defined as guns, howitzers, artillery pieces, combining the characteristics of a gun, howitzer, mortar, or multiple-launch rocket system, capable of engaging surface targets by delivering indirect fire and/or direct fire, with a caliber of 75 millimeters and above Further, the recoil exerciser 1 may not be limited to large caliber weapon systems. Those skilled in the art will appreciate that the recoil exerciser 1 may be adapted for use on other caliber weapon systems which may require recoil exercising.

Figure 2:
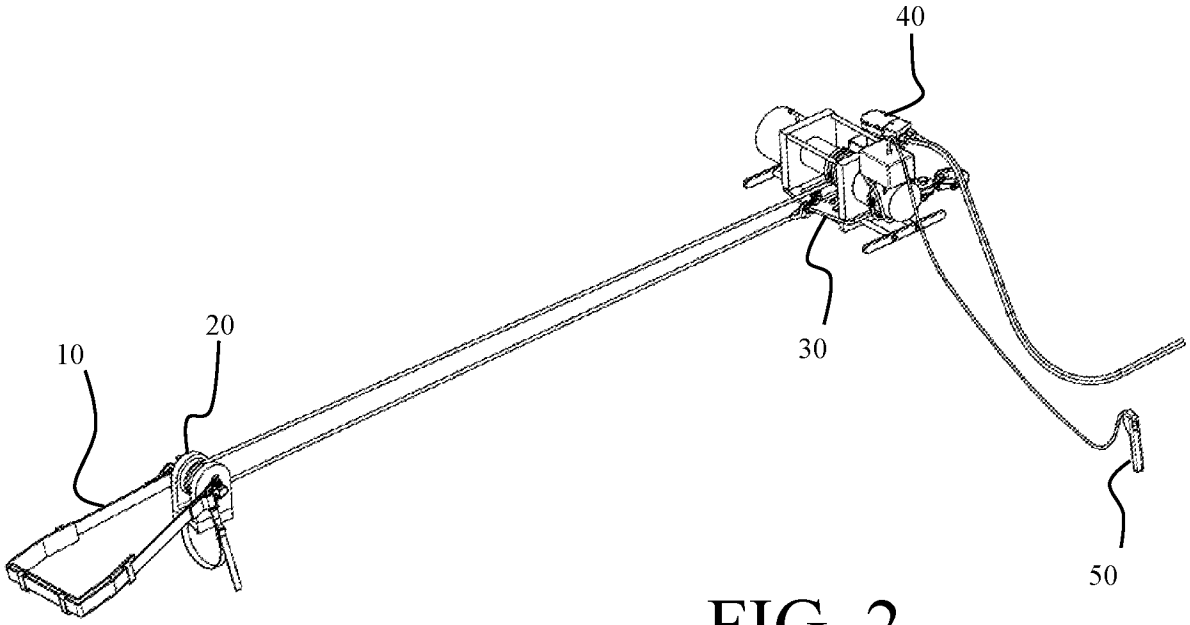
FIG. 2 shows the recoil exerciser, according to an illustrative embodiment of the invention.

FIG. 2 shows the recoil exerciser, according to an illustrative embodiment of the invention. The recoil exerciser 1 comprises a muzzle strap 10, a muzzle pulley subassembly 20, a winch subassembly 30 and a remote subassembly 40. A forward end of the muzzle strap 10 attaches to the muzzle of the weapon system and a rear end of the muzzle strap 10 attaches to the muzzle pulley subassembly 20. The muzzle pulley subassembly 20 is located on top of the muzzle end of the cannon barrel. The winch subassembly 30 is attached to a cradle assembly of the weapon system at the breech end of the cannon barrel. The muzzle pulley subassembly 20 and winch subassembly 30 are connected by a winch rope. A wired remote control interfaces with the winch subassembly. In addition, an external power source provides electric power to the winch subassembly.

Figure 3:
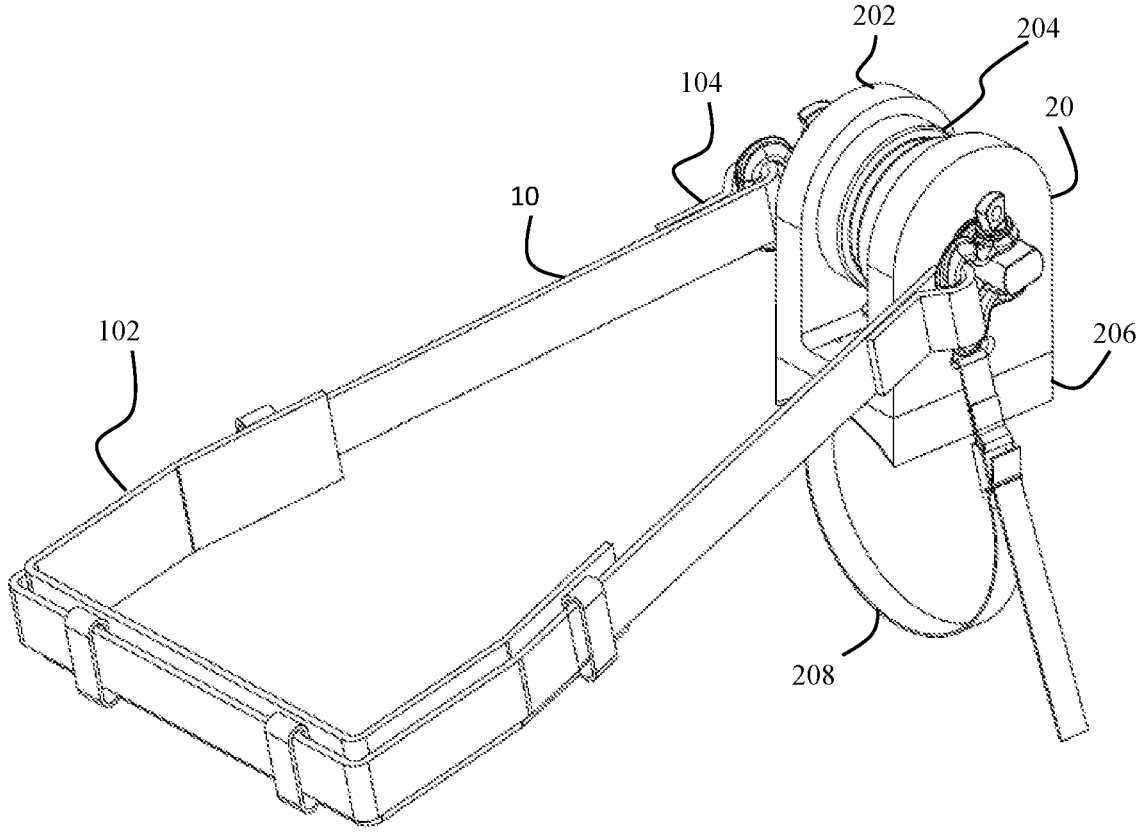
FIG. 3 shows the pulley subassembly of the recoil exerciser, according to an illustrative embodiment of the invention.

FIG. 3 shows the muzzle strap and pulley subassembly of the recoil exerciser, according to an illustrative embodiment of the invention. The muzzle strap 10 may have a muzzle strap protector 102 installed over it to protect the muzzle strap 10 from deterioration. The muzzle strap 10 is fed through a muzzle brake of the cannon and eyes 104 at each end are connected to the muzzle pulley subassembly 20.

The muzzle pulley subassembly 20 further comprises a pulley block and bearing assembly 202 and a pulley shaft 204. The muzzle pulley subassembly 20 is placed on top of the cannon barrel near the muzzle with a glide pad 206 in contact with the cannon barrel. The muzzle pulley subassembly 20 is secured to the cannon barrel using a cinching strap 208 which wraps around the cannon barrel. A winch rope is wound around the pulley shaft 204 and connected to the winch subassembly 30.

Figure 4:
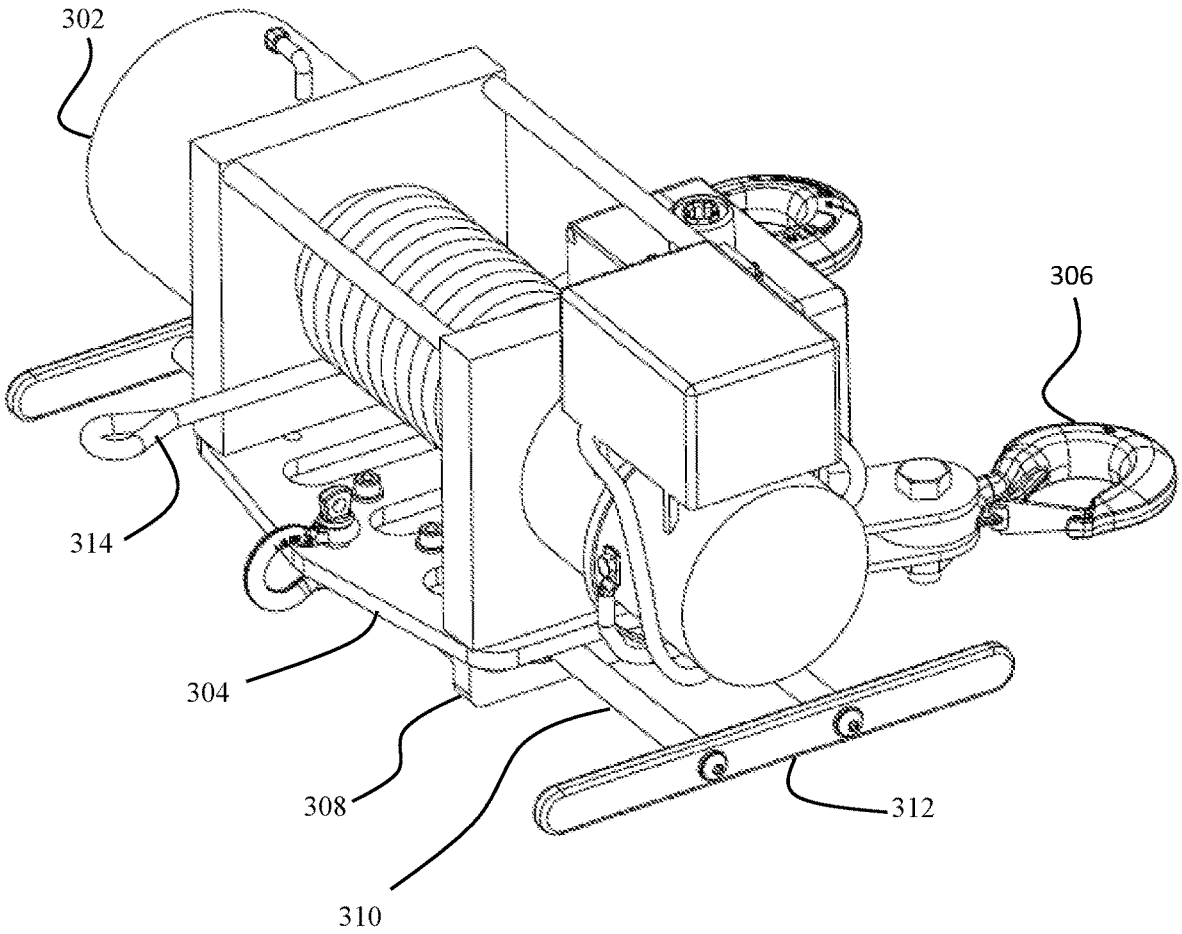
FIG. 4 is a front perspective view of the winch subassembly of the recoil exerciser, according to an illustrative embodiment of the invention.
Figure 5:
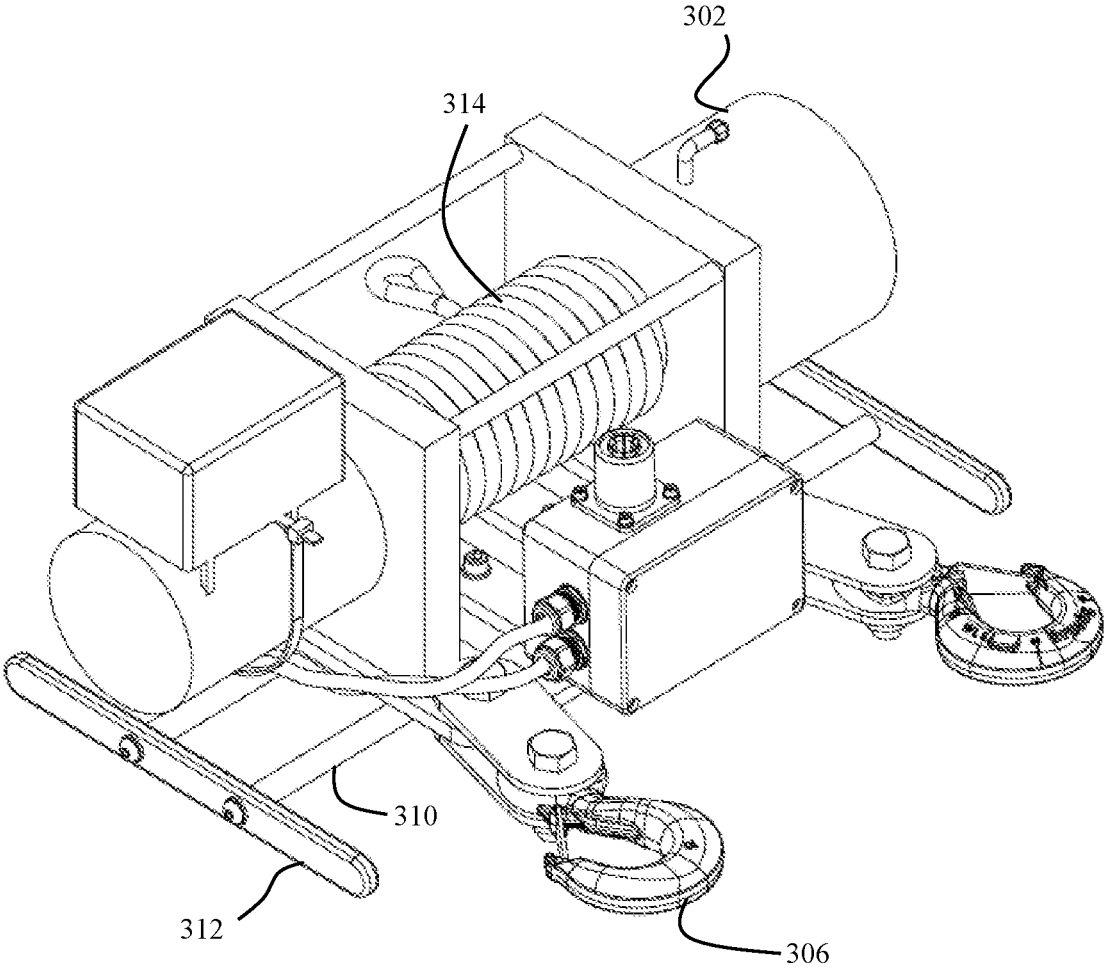
FIG. 5 is a back perspective view of the winch subassembly of the recoil exerciser, according to an illustrative embodiment.
Figure 6:
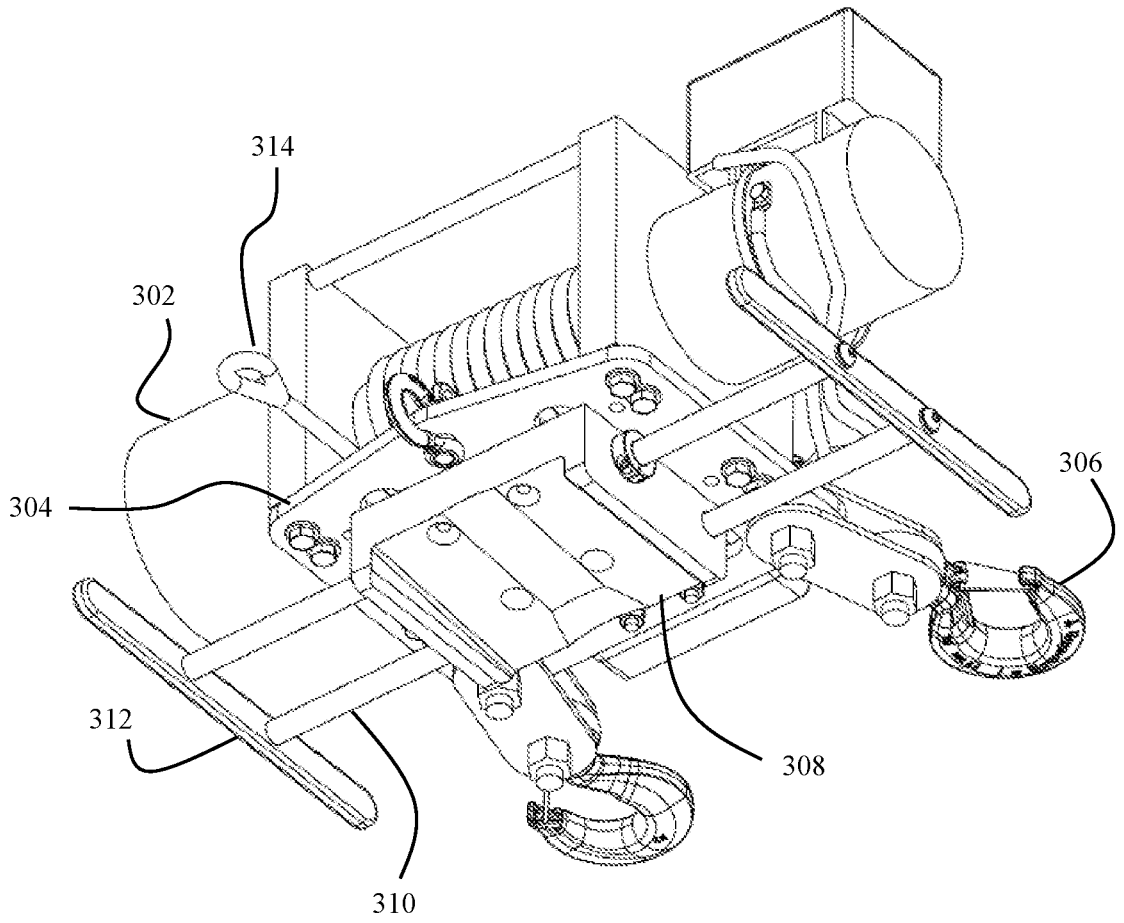
FIG. 6 is a bottom perspective view of the winch subassembly of the recoil exerciser, according to an illustrative embodiment.

FIG. 4 is a front perspective view of the winch subassembly of the recoil exerciser, according to an illustrative embodiment of the invention. FIG. 5 is a back perspective view of the winch subassembly of the recoil exerciser, according to an illustrative embodiment. FIG. 6 is a bottom perspective view of the winch subassembly of the recoil exerciser, according to an illustrative embodiment.

The winch subassembly 30 comprises a winch 302 secured to a winch plate 304. The winch subassembly 30 comprises two hooks 306 for attaching the winch subassembly 30 to the lifting eyes of the cradle assembly of the weapon system. The hooks 306 are connected to the winch plate 304 via hook plates and secured to the hook plates by fasteners. The winch subassembly 30 further comprises a winch saddle 308 for resting on the cannon barrel. Attached to the winch saddle 308 are handle rods 310 and handle bars 312. The winch rope 314 is secured to the winch plate 302 via a shackle.

A winch remote 50 communicates with the winch via a wired interface.

Figure 7:
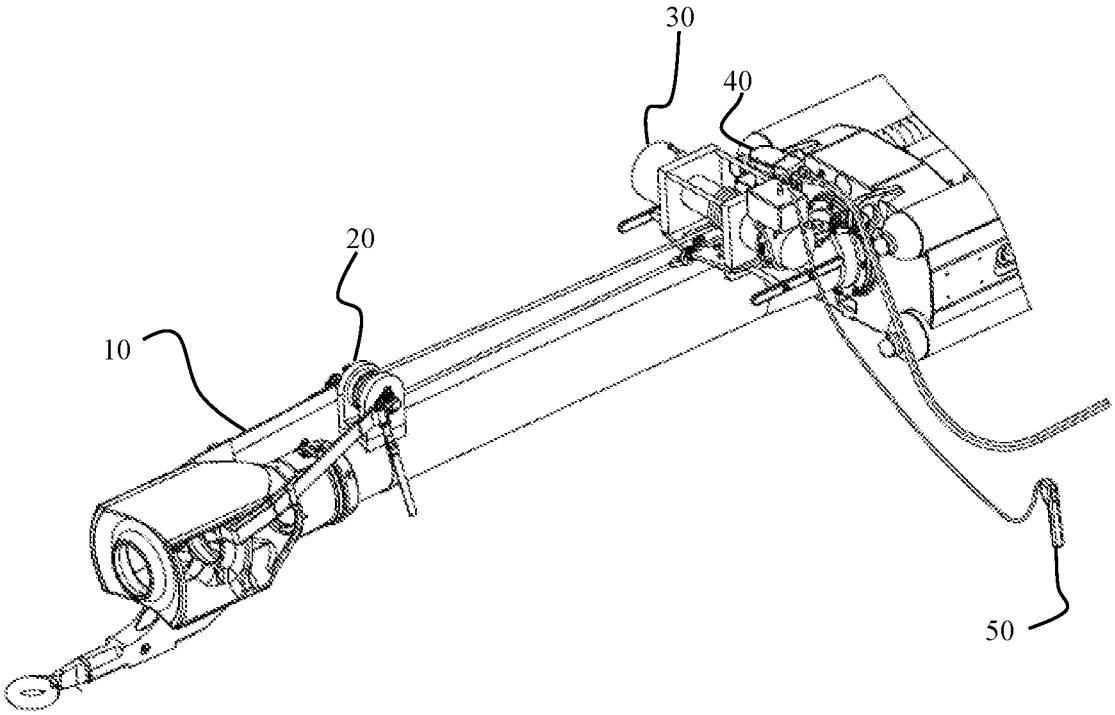
FIG. 7 illustrates the recoil exerciser installed on a large caliber weapon system in a retracted position, according to an embodiment of the invention.

FIG. 7 illustrates the recoil exerciser installed on a large caliber weapon system in a retracted position, according to an embodiment of the invention. To exercise recoil of the weapon system, the recoil exerciser 1 is first installed on the weapon system as described above. The winch is then remotely turned on via the remote. The motive force of the winch causes the cannon barrel to retract in a controlled manner. Once the cannon barrel is retracted over the full recoil stroke, the winch direction is reversed and the cannon is released in a controlled manner.

While the invention has been described with reference to certain embodiments, numerous changes, alterations and modifications to the described embodiments are possible without departing from the spirit and scope of the invention as defined in the appended claims, and equivalents thereof.

What is claimed is:

1. A recoil exerciser for a weapon system, the recoil exerciser comprising:

a muzzle strap for attaching to a muzzle of the weapon system;

a muzzle pulley subassembly receiving the muzzle strap and mounted to a barrel of the weapon system;

a winching assembly attached to a cradle assembly of the weapon system for controllably retracting a rope connected to the muzzle pulley subassembly thereby retracting the barrel of the weapon system and controllably releasing the rope thereby releasing the barrel over a full recoil stroke to exercise a recoil system of the weapon system; and a power supply for providing electric power to the winching assembly.

2. The recoil exerciser of claim 1 wherein the weapon system is a large caliber weapon system.

3. The recoil exerciser of claim 2 wherein the weapon system is a howitzer.

4. The recoil exerciser of claim 1 wherein the muzzle strap is fed through a muzzle brake of the cannon and wherein eyes at each end of said muzzle strap are connected to the muzzle pulley subassembly.

5. The recoil exerciser of claim 1 wherein the muzzle pulley subassembly further comprises a pulley block and bearing assembly and a pulley shaft.

6. The recoil exerciser of claim 5 wherein the muzzle pulley subassembly is placed on a top surface of a muzzle end of the barrel.

7. The recoil exerciser of claim 6 wherein the muzzle pulley subassembly is placed on the top surface with a glide pad in contact with the barrel.

8. The recoil exerciser of claim 6 wherein the muzzle pulley subassembly is secured to the cannon barrel with a cinching strap.

9. The recoil exerciser of claim 1 wherein the winching assembly further comprises:

a winch secured to a winch plate;

a first hook and a second hook for attaching to a first lifting eye and a second lifting eye of the weapon assembly;

and a winch saddle for resting on the barrel.

10. The recoil exerciser of claim 1 wherein a wired remote control interfaces with the winching assembly.

* * * * *